United States Patent [19]

Brinker et al.

[11] Patent Number: 4,688,736

[45] Date of Patent: Aug. 25, 1987

[54] APPARATUS FOR ENGAGING AND LOOSENING THE BEGINNING OF A REEL

[75] Inventors: Alfred Brinker, Gevelsberg; Uwe Dreyer, Wuppertal, both of Fed. Rep. of Germany

[73] Assignee: Maschinenfabrik Fr. Niepmann GmbH & Co., Gevelsberg, Fed. Rep. of Germany

[21] Appl. No.: 818,532

[22] Filed: Jan. 10, 1986

[30] Foreign Application Priority Data

Jan. 29, 1985 [DE] Fed. Rep. of Germany ..... 3502808

[51] Int. Cl.[4] ..... B21C 47/16

[52] U.S. Cl. ..... 242/56 R; 242/66; 242/78.8

[58] Field of Search ..... 242/78.8, 195, 56 R, 242/66, 65; 83/649, 650

[56] References Cited

U.S. PATENT DOCUMENTS

| | | | |
|---|---|---|---|
| 3,010,672 | 11/1961 | Cecil, Jr. | 242/78.8 |
| 3,226,050 | 12/1965 | Engel | 242/78.8 |
| 3,635,417 | 1/1972 | Kajiwara et al. | 242/78.8 |
| 3,767,133 | 10/1973 | Komatsu | 242/78.8 |

*Primary Examiner*—Stuart S. Levy
*Assistant Examiner*—David Werner
*Attorney, Agent, or Firm*—Becker & Becker, Inc.

[57] ABSTRACT

An apparatus for engaging and loosening the beginning of a sheet of material, such as paper, fabric, thin plastic, and/or metal foil, that is wound onto a core to form a reel, so that the material can be used in a subsequent machine, such as a packaging machine. In order to provide such an apparatus, which preferably prepares automatically delivered reels, without manual action, so that it can be further used by a machine, the inventive apparatus includes: a mounting plate; at least two rollers rotatably mounted on the mounting plate and supporting the reel, with one of the rollers being motor-driven; a gripper-like pick-up mechanism for engaging the beginning of the sheet of material when the latter had been secured to the reel for transportation purposes; the pick-up mechanism has a first arm, in the form of a doctor blade, for passing below the beginning of the sheet of material or below a self-sticking strip that secures this beginning; the pick-up mechanism also has a second arm; a mechanism for yieldingly pressing the pick-up mechanism against the periphery of the reel, and in particular for pressing the second arm against the doctor blade in a controlled manner to effect the engagement of the beginning of the sheet material or of the self-sticking strip; the pick-up mechanism is movably mounted in such a way that it executes a nearly tangential movement relative to the reel.

13 Claims, 9 Drawing Figures

APPARATUS FOR ENGAGING AND LOOSENING THE BEGINNING OF A REEL

BACKGROUND OF THE INVENTION

1. Field of the Invention

The present invention relates to an apparatus for engaging and loosening the beginning of a sheet of material, such as paper, fabric, thin plastic, and/or metal foil, that is wound onto a core to form a reel, so that the material can be used in a subsequent machine, such as a packaging machine.

2. Description of the Prior Art

In order to be able to process thin sheets of material, such as of a plactic, metal foil, paper, and fabric, on machines, these materials are wound onto a core to form so-called reels. The end of the wound-up sheet of material, after having been cutoff, is secured to the periphery of the reel for transport purposes. In particular, this securing is effected either by folding the end over and sticking it directly to the layer disposed thereunder, or by sticking it with the aid of an easily detachable self-sticking strip. Such reels are manually, and possibly with the aid of a lifting device, placed upon an unwinding mechanism of a machine for further use, for example with packaging machines in the cigarette industry. After the reels are aligned, the beginning of the reel is loosened by hand from its secured transport position, is pulled off, is cut to size to prepare it for introduction into a machine, and is subsequently threaded into a respective withdrawal device.

In modern high efficiency machines, for example cigarette packaging machines, the operators are burdened by having to frequently change the reels, which become increasingly heavier. Even known auxilary devices for lifting and placing the reels are not in a position to significantly reduce the overall effort up to the point of introducing the beginning of the sheet of material into the machine, since, as previously, the reels must be opened and prepared by hand. For this reason, such auxiliary devices are not economical, and have therefore not gained acceptance in practice.

An object of the present invention is to provide an apparatus for engaging and loosening the beginning of a sheet of material that is wound onto a core to form a reel, so that the material can be used in a subsequent machine, with the inventive apparatus preparing preferably automatically delivered reels, without manual activity, so that they are ready to be further used by such machines.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
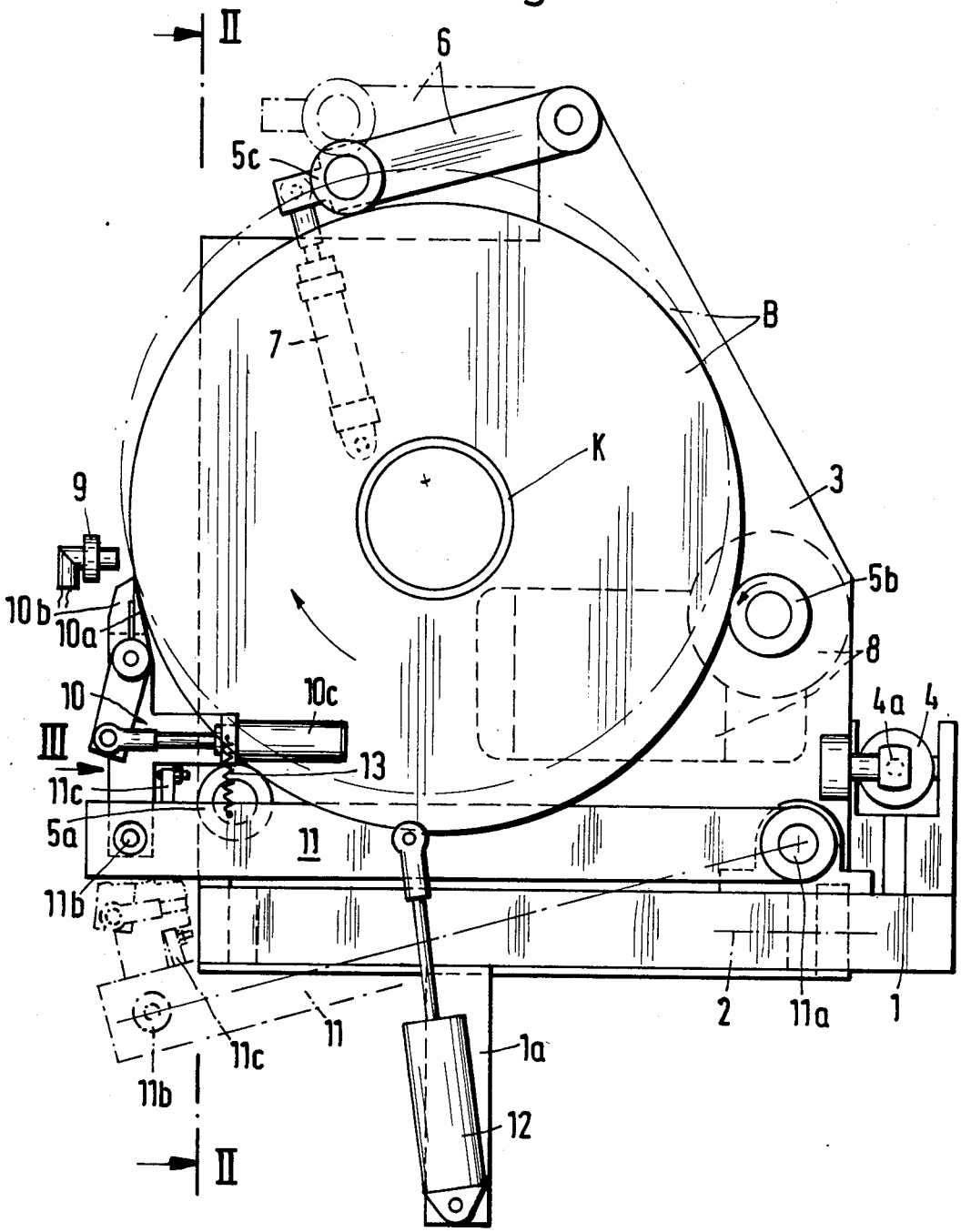
FIG. 1 is a view of one exemplary embodiment of the inventive apparatus in the operating position.

The apparatus of the present invention comprises: a mounting plate; at least two rollers rotatably mounted on the mounting plate and supporting a reel, with one of the rollers being motor-driven; a gripper-like pick-up mechanism for engaging the beginning of a sheet of material when the beginning had been secured to the reel for transportation purposes; the pick-up mechanism has a first arm, in the form of a doctor blade, for passing below the beginning of the sheet of material or below a self-sticking strip that secures the beginning of the sheet of material; the pick-up mechanism also has a second arm; means for yieldingly pressing the pick-up mechanism against the periphery of the reel, and in particular for pressing the second arm of the pick-up mechanism against the doctor blade in a controlled manner to effect the engagement of the beginning of the sheet of material or of the self-sticking strip; the pick-up mechanism is movably mounted in such a way that it executes a nearly tangential movement relative to the reel; a cutting device having a cutter for severing the beginning of the sheet of material during the aforementioned tangential movement of the pick-up mechanism accompanied by rotation of the reel on the rollers, with the severing resulting in a new beginning of the sheet of material; and a transport mechanism for receiving the new beginning of the sheet of material, with the cutting device holding this new beginning until the transport mechanism takes charge thereof.

With the inventive apparatus, the feeding of the reel, the changing of the reel, and the introduction of the respective beginning of the sheet of material can be effected automatically and without manual intervention, so that there is eliminated not only the manual insertion of heavy reels, but also the intricate threading-in. The inventive apparatus has a simple construction and a high operational reliability, so that the apparatus can also be reliably utilized with modern high efficiency machines. The inventive apparatus is suitable for handling all different types and sizes of material without having to change its fundamental construction.

Pursuant to a further feature of the present invention, the mounting plate, together with the rollers and the motor, can be pivoted between a horizontal receiving position and a vertical operating position. This simplifies the feed of the reels to the inventive apparatus, since the reels can be placed from above onto the mounting plate when the latter is in the horizontal receiving position.

Pursuant to a preferred embodiment of the present invention, three rollers are disposed on the mounting plate, with one of the rollers being adjustably mounted on the mounting plate for pressing against the periphery of the respective reel. Such a design requires no exact alignment of the reel that is to be used on the mounting plate, since alignment is effected by the adjustable roller before the mounting plate is pivoted out of the horizontal receiving position into the vertical operating position.

Pursuant to the present invention, the adjustable roller can be rotatably mounted on a pivot arm that is pivotable via a pressure medium cylinder between a receiving position and an operating position. The reel that is to be used is placed upon the mounting plate by the roller that is pivoted into the receiving position, and is subsequently aligned by moving the pivot arm into the operating position before the mounting plate is pivoted into the vertical operating position, for example via a pressure medium cylinder.

In order to bring the beginning of the sheet of material out of the position secured for transport into the position necessary for engagement by the pick-up mechanism, it is proposed pursuant to a further feature of the present invention that the motor that drives the one roller be controlled by a sensor that detects the beginning of the sheet of material via a marking during rotation of the reel that is held between the rollers. The marking can be supplementally added to the periphery of the reel, or can be formed by the self-sticking strips that are provided for securing the beginning of the sheet of material In order that the inventive apparatus also operates satisfactorily when different reel diameters are encountered, it is proposed pursuant to yet another feature of the present invention that that arm of the pick-up mechanism that is embodied as a doctor blade be adapted to be raised from a stop for tangential engagement on the periphery of the reel against spring force. This assures that the pick-up mechanism, during its engagement movement, rests reliably on the periphery of the reel. The pick-up mechanism is preferably disposed on a supporting arm that is moved by a pressure medium cylinder.

Pursuant to a preferred embodiment of the present invention, this supporting arm is pivotably mounted at one end, and the other end if provided with a bearing pin for the pivotable mounting of the pick-up mechanism, as well as with the stop for the pick-up mechanism. This embodiment provides a particularly simple structural design.

Pursuant to the present invention, the movable arm of the pick-up mechanism can either be a rigid component that is pivotable about a point of rotation via a pressure medium cylinder, or can be embodied as a rotatable withdrawing roller. In the latter case, by rotating this withdrawing roller a predetermined length of the sheet of material of the reel can be withdrawn prior to the cutting process; for example, a length can be withdrawn that corresponds to a complete circumference of the reel, thus removing dirty or damaged material.

Also with the embodiment of the movable arm as a rigid component there can be cutoff a predetermined length of the sheet of material that is greater than the length of the withdrawal movement of the pick-up mechanism if, pursuant to a further feature of the present invention, the pick-up mechanism can be moved into an end position disposed below the cutting device, in which position the beginning of the sheet of material is grasped by a rotatable pair of carrier rollers, and is withdrawn to a predetermined length after the pick-up mechanism is opened.

The cutting device of the inventive apparatus is advantageously equipped with a pair of jaws that can be yieldingly pressed together for securing the sheet of material separated by the cutters, so that the newly provided beginning of the sheet of material can be held securely until it is taken hold of by appropriate elements of the subsequently connected transport mechanism. This transport mechanism can be a part of the subsequent packaging machine, or can be part of a supplemental device with which the opened reel is fed to a separate location for further use.

It is finally proposed pursuant to the present invention to associate with the pick-up mechanism two suction devices that can be placed upon the surface of the sheet of material next to the centrally secured beginning of the sheet of material; these suction devices serve to raise the outer corners of the beginning of the sheet of material prior to the latter being engaged by the pick-up mechanism. These suction devices, which are controlled in conformity with the movement of the pick-up mechanism, on the one hand caused that arm of the pick-up mechanism that is embodied as a doctor blade to reliably extend beneath the fixed beginning of the sheet of material, and on the other hand assure that this beginning of the sheet of material is reliably engaged by the movable arm.

DESCRIPTION OF PREFERRED EMBODIMENTS

Figure 2:
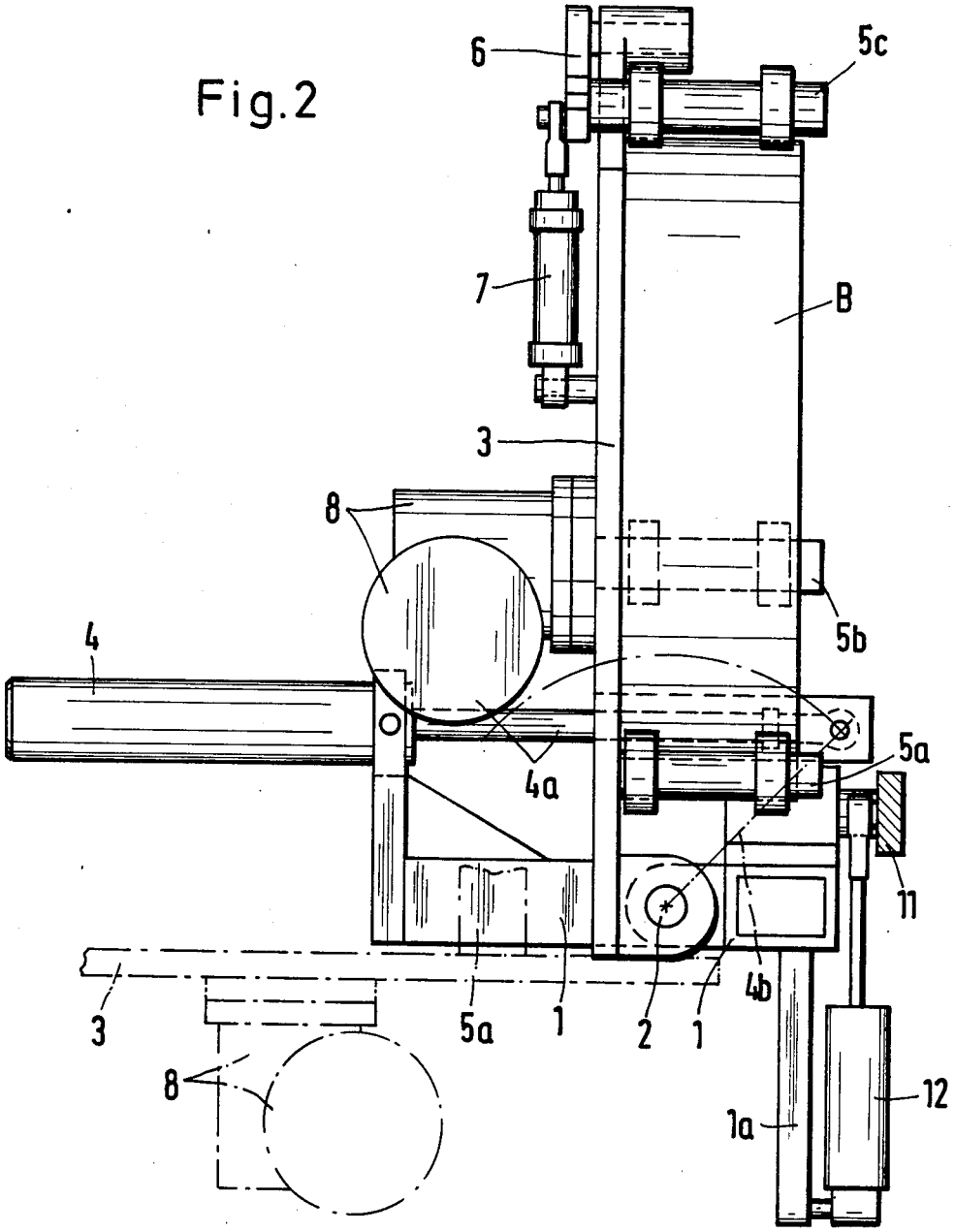
FIG. 2 is a view that shows a vertical section taken along the line II—II in FIG. 1 with solid lines, with dot-dash lines indicating the mounting plate in the receiving position.

Referring now to the drawings in detail, a mounting plate 3 is pivotable, by means of a bearing spindle 2, on a base 1, between a horizontal receiving position and a vertical operating position. The operating position of the mounting plate 3 is illustrated with solid lines in FIGS. 1 and 2; the horizontal receiving position is indicated in FIG. 2 with dot-dashed lines. FIGS. 1 and 2 additionally show a pressure medium cylinder 4 that is disposed on the base 1. The piston rod **4*a* of the cylinder 4 is connected with the mounting plate 3 via a lever 4*b* secured to the bearing spindle 2. In its extended position, the piston rod 4*a* holds the mounting plate 3 in the operating position illustrated in solid lines in FIG. 2. In the retracted position of the piston rod 4*a*, the mounting plate 3 is pivoted into the horizontal receiving position illustrated by dot-dash lines in FIG. 2**.

In the illustrated embodiment, three rollers **5*a*, 5*b*, and 5*c* are rotatably mounted on the mounting plate 3. The rollers 5*a* and 5*b* are fixedly disposed on the mounting plate 3, whereas the roller 5*c* is disposed on the pivotable end of a pivot arm 6, which is controlled by a pressure medium cylinder 7. By means of this cylinder 7, the pivot arm 6, together with the roller 5*c*, can be pivoted out of the receiving position shown in dot-dash lines in FIG. 1** into an operating position illustrated by solid lines.

The rollers **5*a*, 5*b*, and 5*c* serve to hold and support a reel B, which is placed from above onto the mounting plate 3 when the latter is in the horizontal receiving position. In so doing, the reel assumes, for example, the position indicated by dot-dash lines in FIG. 1. By actuating the pressure medium cylinder 7, the roller 5*c* is pressed against the periphery of the reel B, which in this manner is pressed into the final position (indicated by solid lines in FIG. 1) by the force of the pressure medium cylinder 7; in this position, the reel B rests against the rollers 5*a* and 5*b*. Only after this alignment is the mounting plate 3 pivoted into the vertical operating position with the aid of the pressure medium cylinder 4**.

Also shown in FIG. 1 is the core K, onto which the sheet of material of the reel B is wound, and which serves for the transport of the reel B.

Figure 3:
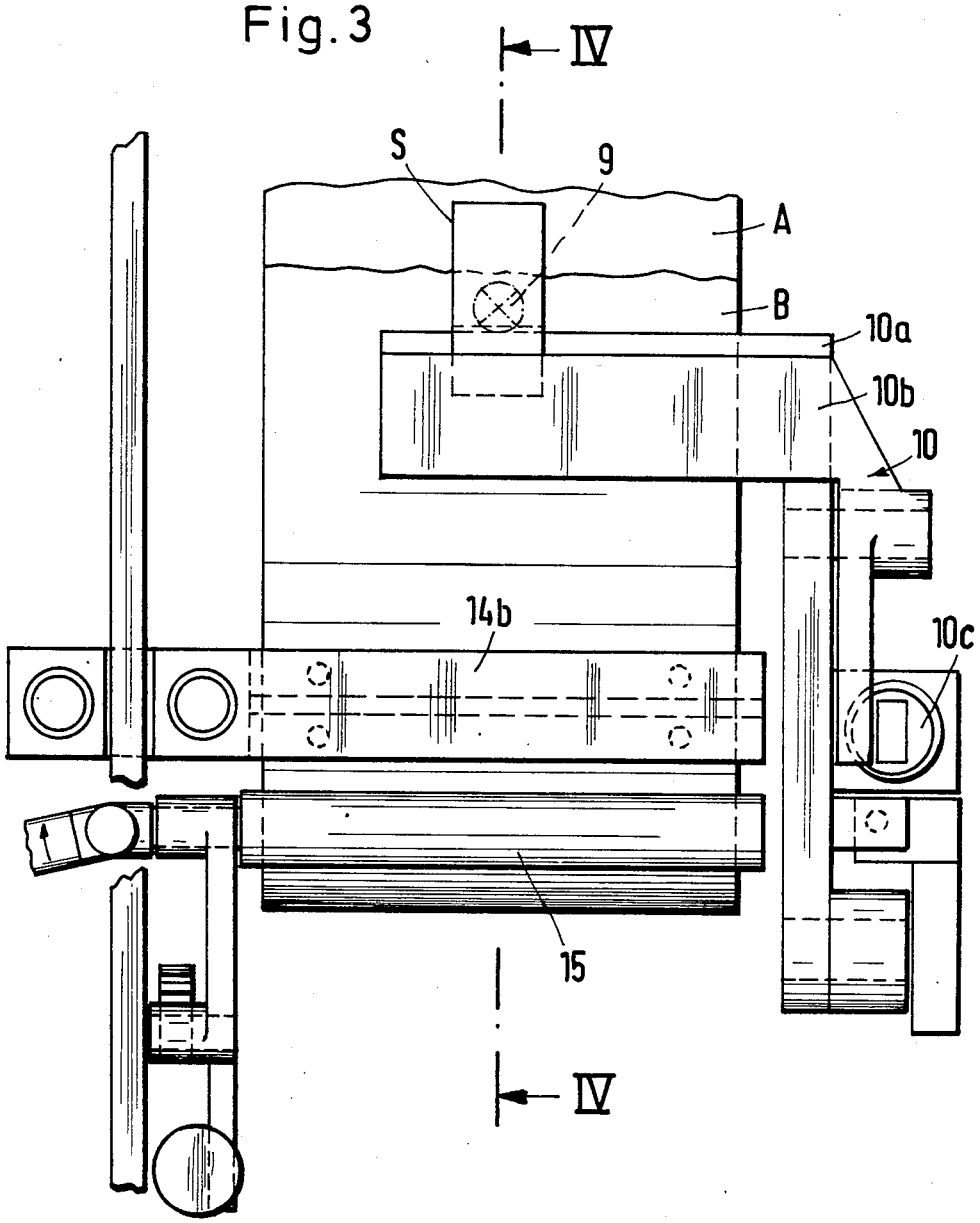
FIG. 3 is an enlarged end view of the pick-up mechanism taken in the direction of the arrow III in FIG. 1.

As shown in FIG. 3, the beginning A of the sheet of material of the reel B is secured during transport of the reel. In order to place the beginning A of the sheet of material in a position suitable for opening the reel B, the roller 5b can be rotated by a motor 8 that is flange-mounted on the back of the mounting plate 3. As a result of the rotation of the roller 5b indicated by an arrow in FIG. 1, the reel B that is resting upon the rollers 5a and 5b is turned in the direction of the arrow until a sensor 9 detects the beginning A of the sheet of material. This detection can be effected by markings that are additionally placed upon the periphery of the reel. As shown in FIG. 3, this marking can also be in the form of a self-sticking strip S that secures the beginning A of the sheet of material to the layer of the reel B therebelow.

Provided for freeing or loosening the beginning A of the sheet of material is a grabber or pick-up mechanism 10, a first embodiment of which is illustrated in FIGS. 1 to 4. This pick-up mechanism 10 includes a first arm, in the form of a scrapper or doctor blade 10a that rests tangentially on the periphery of the reel B; the pick-up mechanism 10 also includes a movable arm 10b. By means of a pressure medium cylinder 10c, this movable arm 10b can be pressed against the doctor blade 10a as soon as the latter contacts the beginning A of the sheet of material or the self-sticking strip S.

After this contact, the pick-up mechanism 10 is moved by an approximately tangential movement relative to the reel B, which is simultaneously rotated. In the embodiment illustrated in FIGS. 1 to 4, in order to achieve this movement the pick-up mechanism 10 is pivotably mounted on the front end of a supporting arm 11, which in turn is pivotably connected to the base 1 on a bearing pin 11a. Pivoting of the supporting arm 11 is effected by a pressure medium cylinder 12, which is disposed on an arm 1a of the base 1. In FIG. 1, the supporting arm 11 is shown, via solid lines, in the operating position, and, in dot-dash lines, in a retracted position. Also shown is the pivotable mounting of the pick-up mechanism 10 via a bearing pin 11b at the front end of the supporting arm 11. In this way it is possible to pull the pick-up mechanism 10 against the force of a spring 13 into the rest position against a stop 11c from which the pick-up mechanism 10 is lifted when it is pressed against the periphery of the reel B by means of the pressure medium cylinder 12, as shown by solid lines in FIG. 1. This embodiment enables a reliable placement of the doctor blade 10a of the pick-up mechanism 10 against the outer periphery of the reel B for contacting an loosening the beginning A of the sheet of material.

Figure 4:
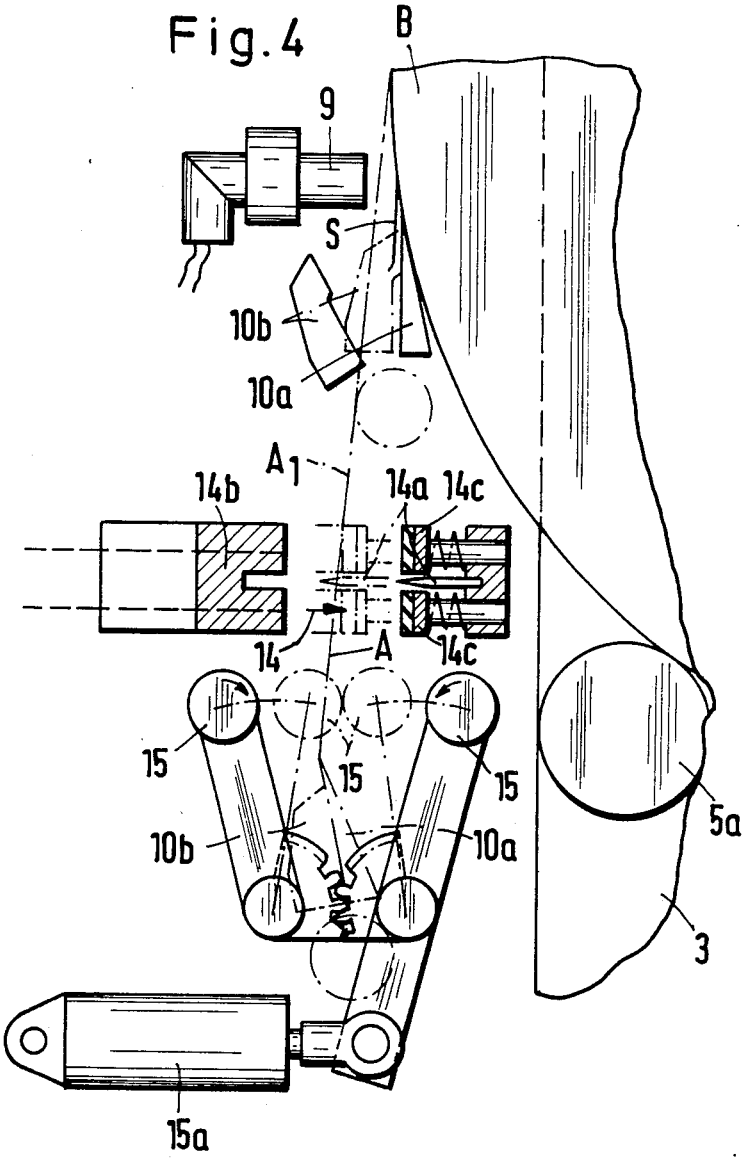
FIG. 4 is a partial cross-sectional view taken along the line IV—IV in FIG. 3.

Via dot-dash lines, FIG. 4 shows the lower position of the pick-up mechanism 10 that is moved with the aid of the supporting arm 11. Also shown is a cutting device disposed in the region between the two end positions of the pick-up mechanism 10. With the aid of this cutting device, the beginning A of the sheet of material withdrawn from the reel B is cut off, so that a new beginning A1 results.

In the embodiment illustrated in FIG. 4, the cutting device 14 comprises a cutter 14a that cooperates with a recess in the pair of jaws 14b, 14c. The Jaw 14c is yieldingly supported relative to a base, so that when the pair of jaws 14b, 14c are pressed together (as shown by dot-dash lines in FIG. 4), the beginning A of the sheet of material is secured between the jaws while at the same time the cutter 14a enters the slot in the jaw 14b. In this way, the front part of the beginning A of the sheet of material is severed. The new beginning A1 that results is secured by the upper part of the pair of jaws 14b, 14c.

If a greater length of the sheet of material is to be cut off, such as a length corresponding to the circumference of the reel B, for example in order to remove dirty or damaged material, this can be accomplished with the embodiment of FIGS. 1 to 4 via a pair of transport rollers 15 that are rotatably and drivingly mounted on levers that are pivotable relative to one another. FIG. 4 shows such a pair of carrier rollers 15 that, after the pick-up mechanism 10 has passed into the lower end position, are transferred via a pressure medium cylinder 15a into the operating position. When the pair of rollers 15 is rotated, with the reel B also rotating, the desired length of the beginning A of the sheet of material is withdrawn, so that the cutter 14a of the cutting device 14 can sever the sheet of material at any desired location.

Figure 5:
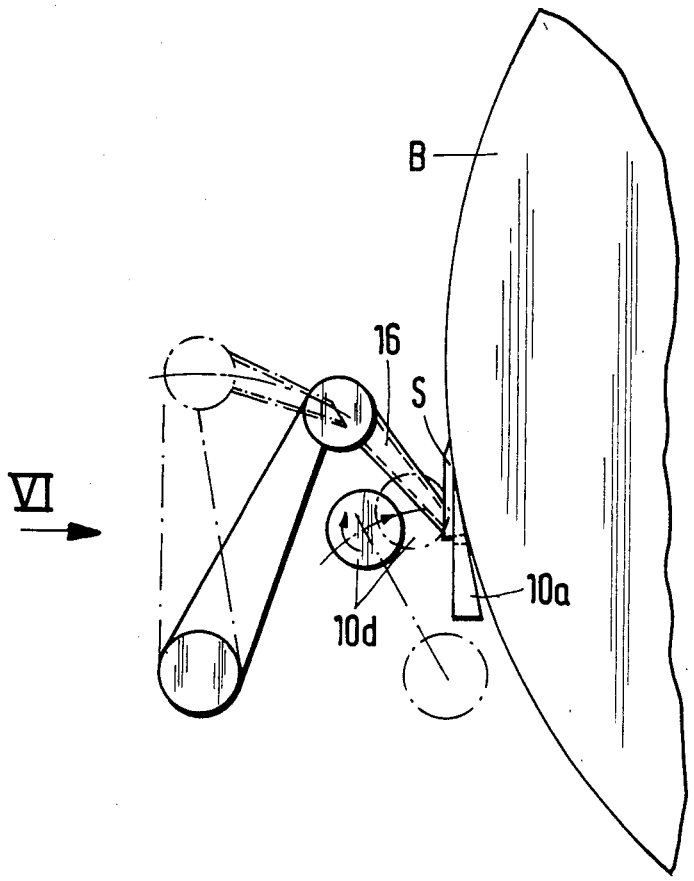
FIG. 5 is a view similar to that of FIG. 4 of an alternative embodiment of the pick-up mechanism.
Figure 7:
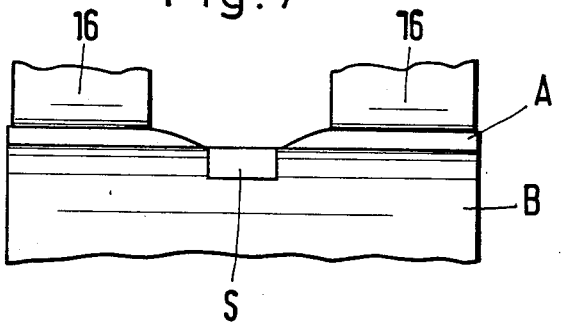
FIG. 7 is a partial view taken in the direction of the arrow VII in FIG. 6.
Figure 6:
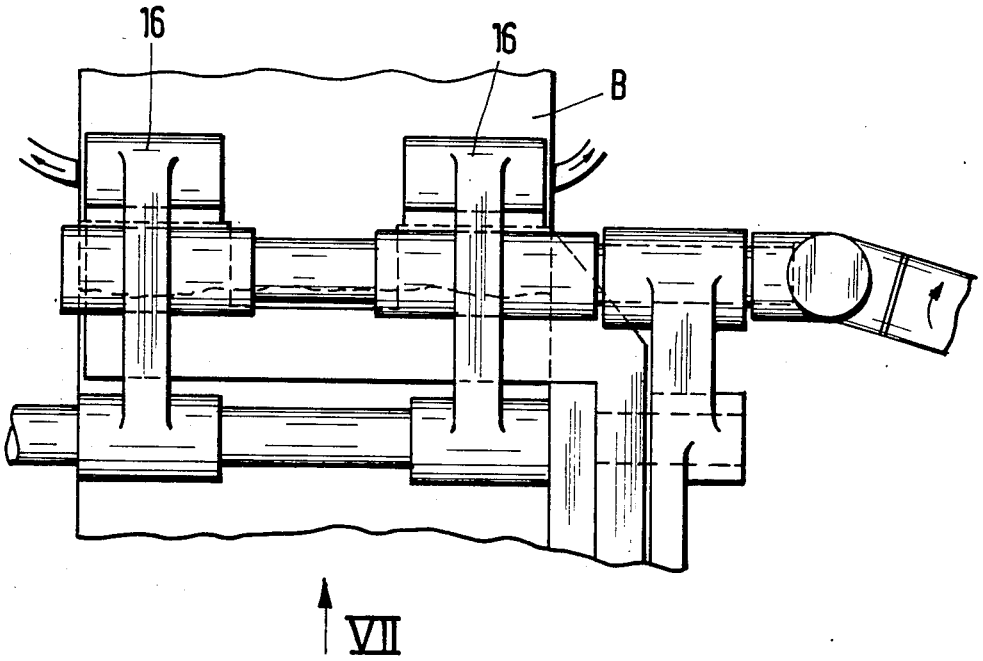
FIG. 6 is a partial view taken in the direction of the arrow VI in FIG. 5.

In the alternative embodiment of the pick-up mechanism 10 illustrated in FIG. 5, the movable arm 10b of the pick-up mechanism 10 is formed by a rotatable withdrawing roller 10d, so that the pair of carrier rollers 15 shown in FIG. 4 can be eliminated for cutting off a greater length of the beginning A of the sheet of material. In conjunction with FIGS. 6 and 7, the embodiment of FIG. 5 also shows suction devices 16 disposed on the sides next to the centrally secured beginning A of the sheet of material. The suction devices can also be used in conjunction with the embodiment of FIG. 1–4. By means of these suction devices 16, the outer corners of the beginning A of the sheet of material are lifted off prior to being contacted by the pick-up mechanism 10, as shown in particular in FIG. 7, and without the suction devices 16 in FIG. 8. The partial vacuum necessary for lifting off the corners of the beginning A is generated in a suitable manner. The suction devices 16 can be moved in a controlled manner as shown in FIG. 5, so that they are pressed against the surface of the reel B only at the required time.

Figure 9:
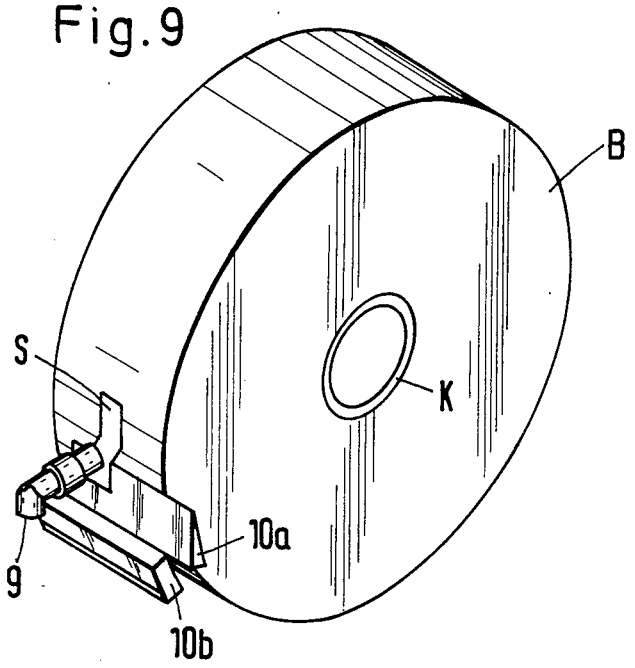
FIG. 9 is a perspective view of a reel and a sensor during detection and engagement of the beginning of a sheet of material, where the beginning has been secured by an adhesive strip.
Figure 8:
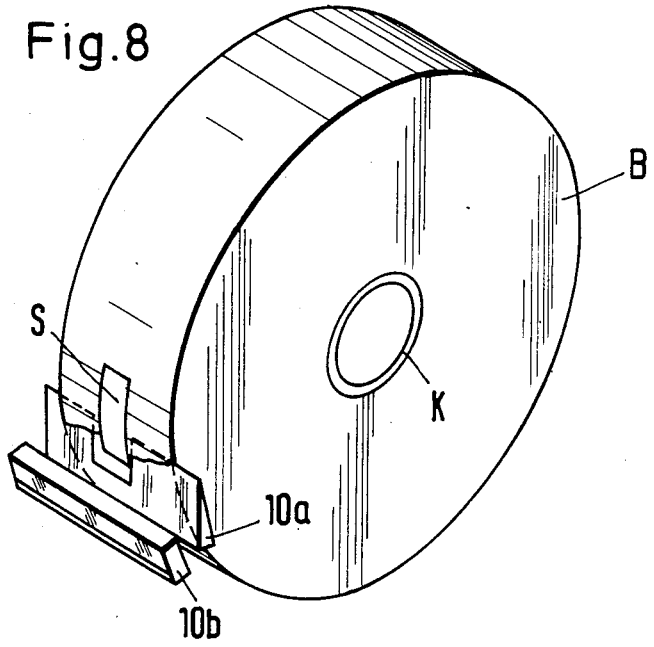
FIG. 8 is a perspective view of a reel where the corners of the beginning of the sheet of material have been raised by suction devices, though the latter have been omitted in order to facilitate illustration.

As shown in FIG. 8, when the suction devices 16 are used, the doctor blade 10a of the pick-up mechanism 10 is provided with a central cutout for the self-sticking strip S FIG. 9 shows the action of the sensor 9, which in this case detects the self-sticking strip S.

The present invention is, of course, in no way restricted to the specific disclosure of the specification and drawings, but also encompasses any modifications within the scope of the appended claims.

What we claim is:

1. An apparatus for engaging and loosening the beginning of a sheet of material that is wound onto a core to form a reel, so that said material can be used in a subsequent machine; said apparatus comprises:

a mounting plate;

at least two rollers rotatably mounted on said mounting plate and supporting said reel, with one of said rollers being motor-driven;

a gripper-like pick-up mechanism for engaging said beginning of a sheet of material when said beginning had been secured to said reel for transportation purposes; said pick-up mechanims has a first arm, in the form of a doctor blade, for extending below said beginning of a sheet of material, or below a self-sticking strip that secures said beginning to said reel; said pick-up mechanism also has a second arm;

means for yieldingly pressing said pick-up mechanism against the outer periphery of said reel, and in particular for pressing said second arm of said pick-up mechanism against said doctor blade thereof in a controlled manner to effect said engagement of aid beginning of a sheet of material or of said self-sticking strip; said pick-up mechanism is movably mounted in such a way that it executes a nearly tangential movement relative to said reel;

a cutting device having a cutter for severing said beginning of a sheet of material during said tangential movement of said pick-up mechanism accompanied by rotation of said reel on said rollers, with said severing resulting in a new beginning of said sheet of material; and a transport mechanism for receiving said new beginning.

2. An apparatus according to claim 1, which includes means for pivoting said mounting plate, together with said rollers and said motor, between a horizontal position for receiving a reel, and a vertical operating position.

3. An apparatus according to claim 2, in which three of said rollers are mounted on said mounting plate, with one of said rollers being adjustably mounted on said mounting plate so that it can be pressed against the outer periphery of a reel.

4. An apparatus according to claim 3, which includes a pivot arm that is pivotably mounted on said mounting plate, with said adjustable roller being rotatably mounted on said pivot arm; and which includes a pressure medium cylinder for pivoting said pivot arm between a receiving position and an operating position.

5. An apparatus according to claim 1, which includes marking means on said reel; and which includes a sensor that controls the motor of said motor-driven roller, and also detects, via said marking means, said beginning of a sheet of material during rotation of a reel held between said rollers.

6. An apparatus according to claim 1, which includes spring means for urging said pick-up mechanism away from the outer periphery of a reel and against a stop, with said means for yieldingly pressing said pick-up mechanism lifting the latter from said stop, against the force of said spring means, for tangential engagement of said doctor blade against the outer periphery of a reel.

7. An apparatus according to claim 6, in which said means for yieldingly pressing said pick-up mechanism includes a movable supporting arm on which said pick-up mechanism is disposed, and a first pressure medium cylinder for moving said supporting arm.

8. An apparatus according to claim 7, which includes a base on which said mounting plate is disposed; and in which said supporting arm has two ends, one of which is pivotably mounted on said base, and the other of which is provided with said stop as well as with a bearing pin for effecting pivotable mounting of said pick-up mechanism on said supporting arm.

9. An apparatus according to claim 1, in which said second arm of said pick-up mechanism is a rigid component that is pivotable about a point of rotation; and in which said means for yieldingly pressing said pick-up mechanism includes a second pressure medium cylinder for pivoting said rigid second arm.

10. An apparatus according to claim 1, in which said second arm of said pick-up mechanism is a rotatable withdrawing roller.

11. An apparatus according to claim 1, in which said pick-up mechanism is adapted to hold said beginning of a sheet of material and move, with said beginning, to a position on that side of said cutting device remote from said reel; and in which said transport mechanism includes a pair of carrier rollers for grasping said beginning of a sheet of material and withdrawing it from said reel after release thereof by said pick-up mechanism.

12. An apparatus according to claim 1, in which said cutting device is provided with a pair of jaws that can be yieldingly pressed together for holding material severed by said cutter.

13. An apparatus according to claim 1, in which said beginning of a sheet of material is centrally secured to said reel; and in which said pick-up mechanism is provided with two suction devices disposed on both sides of said central securement for placement on the surface of said reel to lift off the outer corners of said beginning of a sheet of material prior to said engagement thereof by said pick-up mechanism.

* * * * *